US007770373B2

(12) United States Patent
Sawada

(10) Patent No.: US 7,770,373 B2
(45) Date of Patent: Aug. 10, 2010

(54) CORE FIBER DETECTING METHOD AND DEVICE IN CORE YARN SPINNING

(75) Inventor: Harutoshi Sawada, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 358 days.

(21) Appl. No.: 11/919,986

(22) PCT Filed: Jan. 30, 2006

(86) PCT No.: PCT/JP2006/301466

§ 371 (c)(1),
(2), (4) Date: Nov. 6, 2007

(87) PCT Pub. No.: WO2006/123454

PCT Pub. Date: Nov. 23, 2006

(65) Prior Publication Data

US 2009/0044510 A1 Feb. 19, 2009

(30) Foreign Application Priority Data

May 16, 2005 (JP) ..... 2005-142341
Aug. 22, 2005 (JP) ..... 2005-240065

(51) Int. Cl.
*D01H 13/26* (2006.01)

(52) U.S. Cl. ..... 57/264

(58) Field of Classification Search ..... 57/3, 57/5, 264, 265
See application file for complete search history.

(56) References Cited

U.S. PATENT DOCUMENTS 4,672,801 A * 6/1987 Abduganiev et al. ..... 57/86
4,848,072 A * 7/1989 Sakai et al. ..... 57/261
5,619,848 A * 4/1997 Costales et al. ..... 57/261
6,370,858 B1 * 4/2002 Mori ..... 57/6
6,655,122 B2 * 12/2003 Shigeyama et al. ..... 57/5

(Continued)

FOREIGN PATENT DOCUMENTS

EP 0484601 6/1992

(Continued)

OTHER PUBLICATIONS

Notice of Rejection for Chinese Patent App. No. 2006800166424 (Jul. 10, 2009) with English translation.

(Continued)

*Primary Examiner*—Shaun R Hurley
(74) *Attorney, Agent, or Firm*—Cermak Nakajima LLP; Tomoko Nakajima

(57) ABSTRACT

The presence/absence of a core fiber in a core yarn is reliably detected to prevent production of a core fiber-free core yarn. In a method for producing a core yarn C by wrapping a fiber bundle S around a core fiber F, the core yarn C is spun with a core fiber F content being changed from that of normal spinning for a predetermined time period after the start of spinning, in order to detect whether the core fiber F is present. The core yarn C may be spun with a core fiber made of a drawn elastic yarn to detect whether the core fiber is present based on a thickness fluctuation of the core yarn that is caused by slackening the core yarn.

28 Claims, 12 Drawing Sheets

U.S. PATENT DOCUMENTS

| | | | | |
|---|---|---|---|---|
| 7,437,867 | B2 * | 10/2008 | Sawada | 57/3 |
| 7,437,868 | B2 * | 10/2008 | Baba et al. | 57/5 |
| 2002/0026781 | A1 * | 3/2002 | Shigeyama et al. | 57/12 |

FOREIGN PATENT DOCUMENTS

| | | | |
|---|---|---|---|
| JP | 03-167330 | A | 7/1991 |
| JP | 04-352828 | | 12/1992 |
| JP | 11-107094 | | 4/1999 |
| JP | 3178388 | B2 | 6/2001 |
| JP | 3185840 | B2 | 7/2001 |
| JP | 2002-363834 | A | 12/2002 |

OTHER PUBLICATIONS

Office Action for Japanese Patent App. No. 2005-240065 from Japan Patent Office (May 13, 2009), and English Translation thereof.
International Search Report mailed on Apr. 4, 2006.

* cited by examiner (a)

(b)

(a)

(b)

(a)

(b)

CORE FIBER DETECTING METHOD AND DEVICE IN CORE YARN SPINNING

TECHNICAL FIELD

The present invention relates to a core fiber detecting method and device in core yarn spinning for detecting the presence/absence of a core fiber in a core yarn.

BACKGROUND ART

One exemplary apparatus for producing a core yarn having a core fiber provided in a fiber bundle is a core yarn production apparatus as in Patent Document 1. In this production apparatus, a spinning device produces a core yarn by spinning using a core fiber, which is an elastic yarn supplied from a core fiber supply device, and covering fibers, which consist of a fiber bundle drafted by a drafting device. The core fiber supply device is provided with a core fiber detection sensor for detecting the core fiber, and when the sensor detects the absence of the core fiber, the spinning operation is stopped.

In the above-described core yarn production apparatus, however, the spinning might be carried out without placing the core fiber in the covering fibers, even when the core fiber detection sensor detects the core fiber. For example, when core yarns are spliced together, the core fiber might be suctioned into a suction nozzle after passing by an air spinning device, so that a yarn composed only of the covering fibers is spun by the spinning device. As a result, the yarn without a core fiber is wound into a package.

[Patent Document 1] Japanese Laid-Open Patent Publication No. 2002-363834 (elastic core fiber detection sensor 32 in FIG. 4, and paragraph 0058)

DISCLOSURE OF THE INVENTION

Problems to be Solved by the Invention

In view of the above-described circumstances, the present invention seeks to solve the problem of providing a core fiber detecting method and device in core yarn spinning for reliably detecting the presence/absence of a core fiber in a core yarn, thereby preventing production of a core yarn without a core fiber.

Solution to the Problem

To solve the above problem, a core fiber detecting method and device in core yarn spinning as configured below are provided. A core fiber detecting method according to the present invention is for use in a method for producing a core yarn by wrapping a fiber bundle around a core fiber, in which the core yarn is spun with a core fiber content (the ratio of a core fiber to the fiber bundle) being changed from that of normal spinning for a predetermined time period after spinning is started, in order to detect whether the core yarn contains the core fiber.

Preferably, the core yarn is spun into a finer-count yarn than in a normal operation, thereby changing the core fiber content.

More preferably, a rotational speed of a predetermined drafting roller in a drafting device is, adjusted to change the count of the core yarn.

Alternatively, the core yarn may be spun with a core fiber made of a drawn elastic yarn, and whether the core fiber is present may be detected based on a thickness fluctuation of the core yarn that is caused by slackening the core yarn.

Preferably, the core yarn is spun with a core fiber drawn at a higher rate than in a normal operation, thereby changing the core fiber content.

A core fiber detecting device according to the present invention is a device for detecting whether a core fiber is present, which is included in an apparatus for producing a core yarn by wrapping a fiber bundle around the core fiber, in which the device comprises content changing means for spinning the core yarn with a changed core fiber content, and the core yarn is spun with the core fiber content being changed from that of normal spinning for a predetermined time period after spinning is started, in order to detect whether the core yarn contains the core fiber.

Preferably, the content changing means is a device that spins the core yarn into a finer-count yarn than in a normal operation.

More preferably, the content changing means includes a device that changes a rotational speed of a predetermined drafting roller in a drafting device.

Alternatively, the core yarn production apparatus may spin the core yarn with a core fiber made of a drawn elastic yarn, and the core fiber detecting device may detect whether the core fiber is present based on a thickness fluctuation of the core yarn that is caused by slackening the core yarn.

Preferably, the content changing means is a device that changes a drawn rate of the elastic core fiber.

EFFECT OF THE INVENTION

In some cases with the core fiber content for normal spinning, the core yarn does not significantly vary in thickness between when the core fiber is present and when the core fiber is absent. In such cases, it is difficult to detect the presence/absence of the core fiber based on the difference in thickness, and therefore the core fiber content is changed for a predetermined time period after the start of spinning to increase the difference in radial thickness of the core yarn between when the core fiber is present and when the core fiber is absent, making it possible to reliably determine the presence/absence of the core fiber. After confirming that the core yarn contains the core fiber, the core yarn is produced with a predetermined yarn count, making it possible to reliably prevent a core fiber-free core yarn from being taken up.

In normal spinning for producing a coarse-count core yarn with a fine denier core fiber, the coarse-count core yarn does not substantially vary in thickness between when the core fiber is present and when the core fiber is absent, and therefore it is difficult to detect the presence/absence of the core fiber. Accordingly, the core yarn is spun into a finer-count yarn only for a predetermined time period after the start of spinning to increase the difference in diameter of the core yarn, thereby making it possible to reliably detect the presence/absence of the core fiber.

The count of the core yarn is preferably changed by adjusting the rotational speed of predetermined drafting rollers in the drafting device. For example, back rollers and third rollers in the core yarn spinning machine can be adjusted in speed for each spinning unit, and therefore it is possible to readily change the count of the core yarn even when yarn splicing is carried out by any given spinning unit.

By causing the core fiber to contract due to elastic force, the core yarn containing an elastic core fiber undergoes a change in diameter, and expands radially. By using such a change, the core yarn is slackened, and a value based on the thickness change of the core yarn is compared with a preset threshold, making it possible to detect whether the core yarn contains the elastic core fiber.

Alternatively, the core yarn may be spun with a core fiber drawn at a higher rate than in normal operation in order to change the core fiber content. By increasing the drawn rate of the core fiber to increase the restoring force, the thickness of the core yarn fluctuates more significantly when the core yarn is slackened, making it possible to reliably detect the presence/absence of the core fiber.

DESCRIPTION OF THE REFERENCE CHARACTERS

Figure 1:
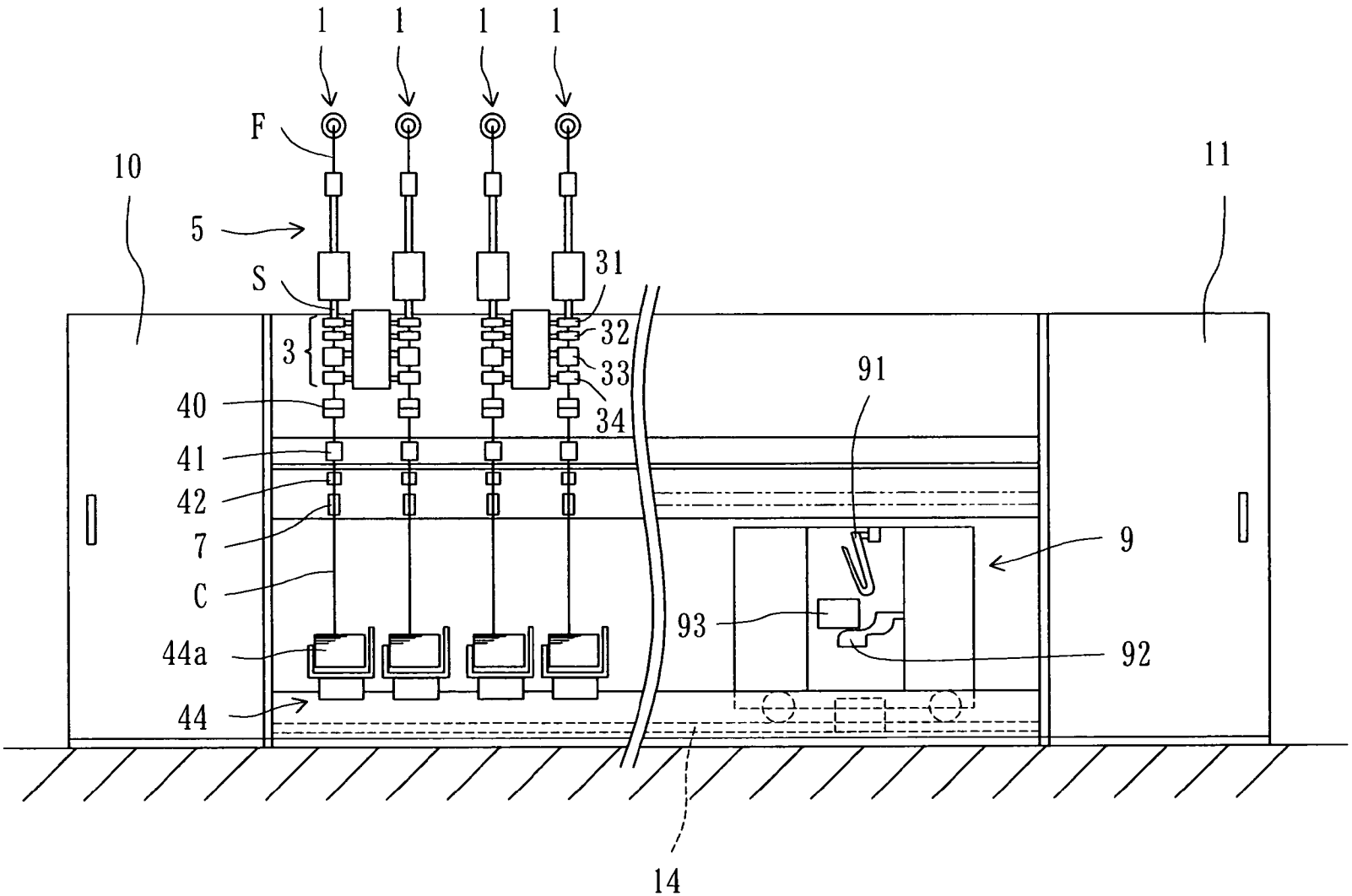
FIG. 1 is a general front view illustrating a core yarn spinning machine in a first embodiment.

1 spinning unit (yarn processing unit)
13 spinning unit controller
2 elastic core fiber supply device
3 drafting device
31 back roller
32 third roller
33 middle roller
34 front roller
35 drive motor
36 belt
5 core fiber supply device
7 slub catcher (core fiber presence/absence determination device)
71 detecting portion
72 light emitting portion
73 light reception portion
74 slub catcher controller
75 control portion
76 memory portion
77 comparison portion
9 yarn splicer carriage
91 supply-side yarn end catching means (suction pipe)
92 take-up-side yarn end catching means (suction mouth)
93 yarn splicing device
S sliver
F core fiber
D elastic core fiber
C core yarn
B spun yarn

BEST MODES FOR CARRYING OUT THE INVENTION

Hereinafter, a core fiber detecting method and device in core yarn spinning according to the present invention will be described in detail with reference to the accompanying drawings.

First Embodiment

Figure 2:
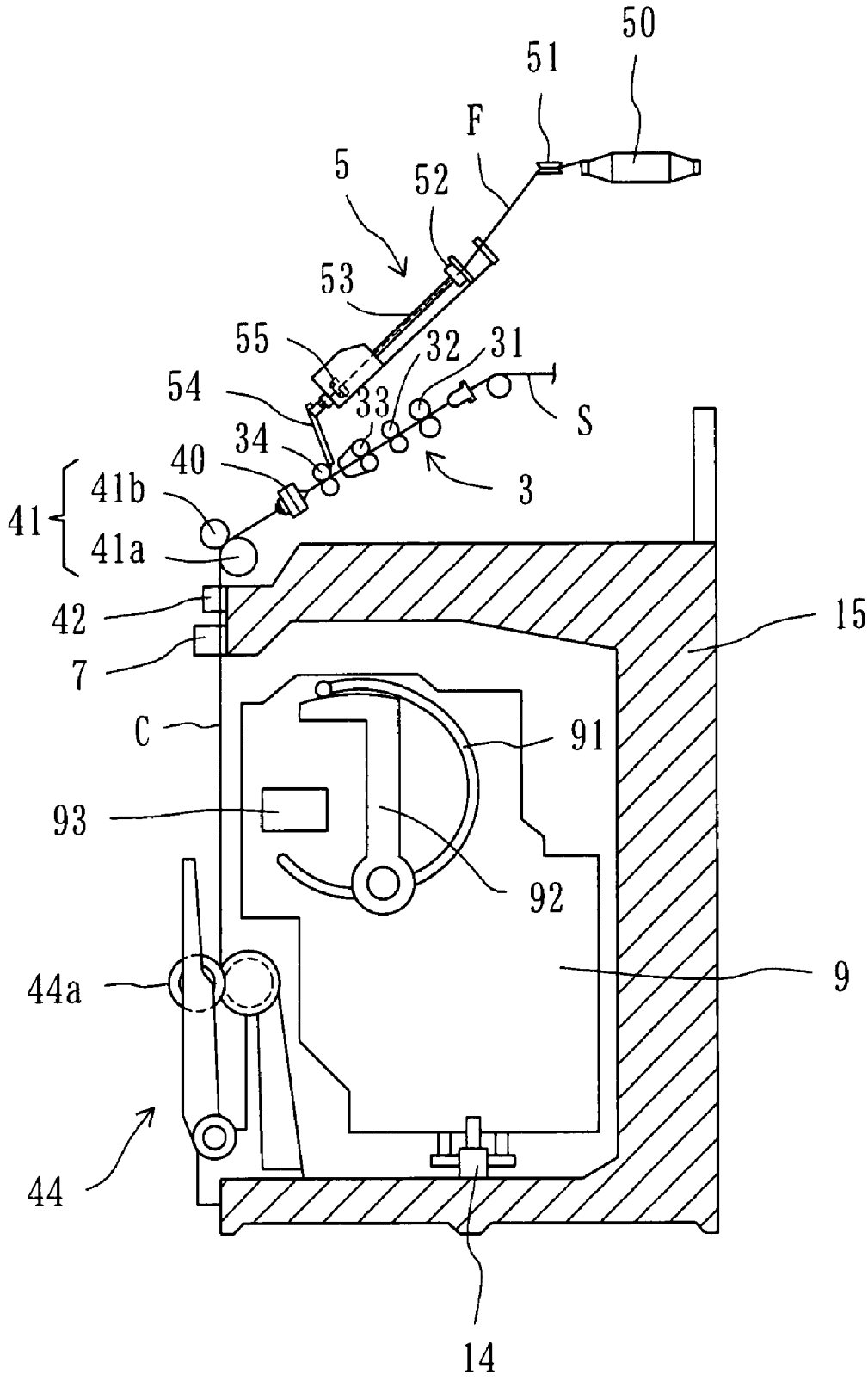
FIG. 2 is a partial cross-sectional side view of FIG. 1.

FIG. 1 is a general front view illustrating a core yarn spinning machine. FIG. 2 is a partial cross-sectional side view of FIG. 1. The core yarn spinning machine has a number of spinning units (yarn processing units) 1, 1, 1, . . . , arranged in parallel between a motor box 10 and a dust box 11. Furthermore, the core yarn spinning machine has a rail 14 provided along the spinning units 1, 1, 1, . . . , such that a yarn splicer carriage 9 can reciprocate horizontally along the rail 14. The yarn splicer carriage 9 carries out a yarn splicing operation after traveling to and stopping at a spinning unit 1 for which yarn splicing is requested.

Each spinning unit 1 includes a drafting device 3, a core fiber supply device 5, a spinning device 40, a yarn feeding device 41 and a take-up device 44. The drafting device 3 has back rollers 31, third rollers 32, middle rollers 33 and front rollers 34. The core fiber supply device 5 has a bobbin 50, etc. The spinning device 40 has an air jet nozzle, etc., and the take-up device 44 includes a take-up package 44*a*, etc.

After being withdrawn from a sliver case (not shown) provided at the back of a machine frame 15, a sliver S is supplied to the back rollers 31 and drafted (drawn) by the drafting device 3. Then, a core fiber F supplied from the core fiber supply device 5 is merged with a fiber bundle between the middle rollers 33 and the front rollers 34 in the drafting device 3. The core fiber F is, for example, a nonstretchable filament yarn made of synthetics such as polyester. The spinning device 40 carries out spinning by applying a swirling flow of compressed air onto the fiber bundle, thereby covering the core fiber F with the sliver S to create a core yarn C.

After being discharged from the spinning device 40, the core yarn C is fed downward from the yarn feeding device 41 through a cutter device 42, which eliminates a yarn defect, and a slub catcher (yarn defect detector) 7, which detects a yarn defect, and then to the take-up device 44 by which the core yarn C is taken up onto the take-up package 44*a*. The slub catcher 7 has, for example, a function of detecting unevenness of yarn thickness and a function of detecting a foreign substance contained in a yarn.

The yarn feeding device 41 is composed of a delivery roller 41*a* and a nip roller 41*b* provided in contact with the delivery roller 41*a*. The core yarn C discharged from the spinning device 40 is nipped between the delivery roller 41*a* and the nip roller 41*b*, and fed downward by rotational drive of the delivery roller 41*a*.

The core fiber supply device 5 has the bobbin 50, a tenser 51 for applying a predetermined tension to the core fiber F unwound from the bobbin 50, and an air sucker device 52 for suctioning the core fiber F and feeding it to the downstream side. Furthermore, the core fiber supply device 5 includes a clamp/cutter 55 for cutting/clamping the core fiber F.

After being unwound from the bobbin 50, the core fiber F is supplied through, from the upstream side, the tenser 51, the air sucker device 52, a yarn guiding tube 53 and a supply guiding tube 54 to a position slightly upstream of the front rollers 34, and merged with the fiber bundle made of the sliver S before being introduced into the spinning device 40.

The yarn splicer carriage 9 includes: a suction pipe (supply-side yarn end catching means) 91 for suctioning and catching a core yarn C successively supplied from the spinning device 40 on the supply side; a suction mouth (take-up-side yarn end catching means) 92 for suctioning and catching a core yarn C on the take-up package 44*a*; and a yarn splicing device 93 for splicing together the core yarns C respectively caught by the suction pipe 91 and the suction mouth 92. At the ends of the suction pipe 91 and the suction mouth 92, a suction airflow is generated by a suction flow generation source 95 (see FIG. 3) to suction and catch yarn ends. The yarn splicing device 93 is composed of a clamping member, a cutting member and a splicer, etc., which are not shown.

Figure 3:
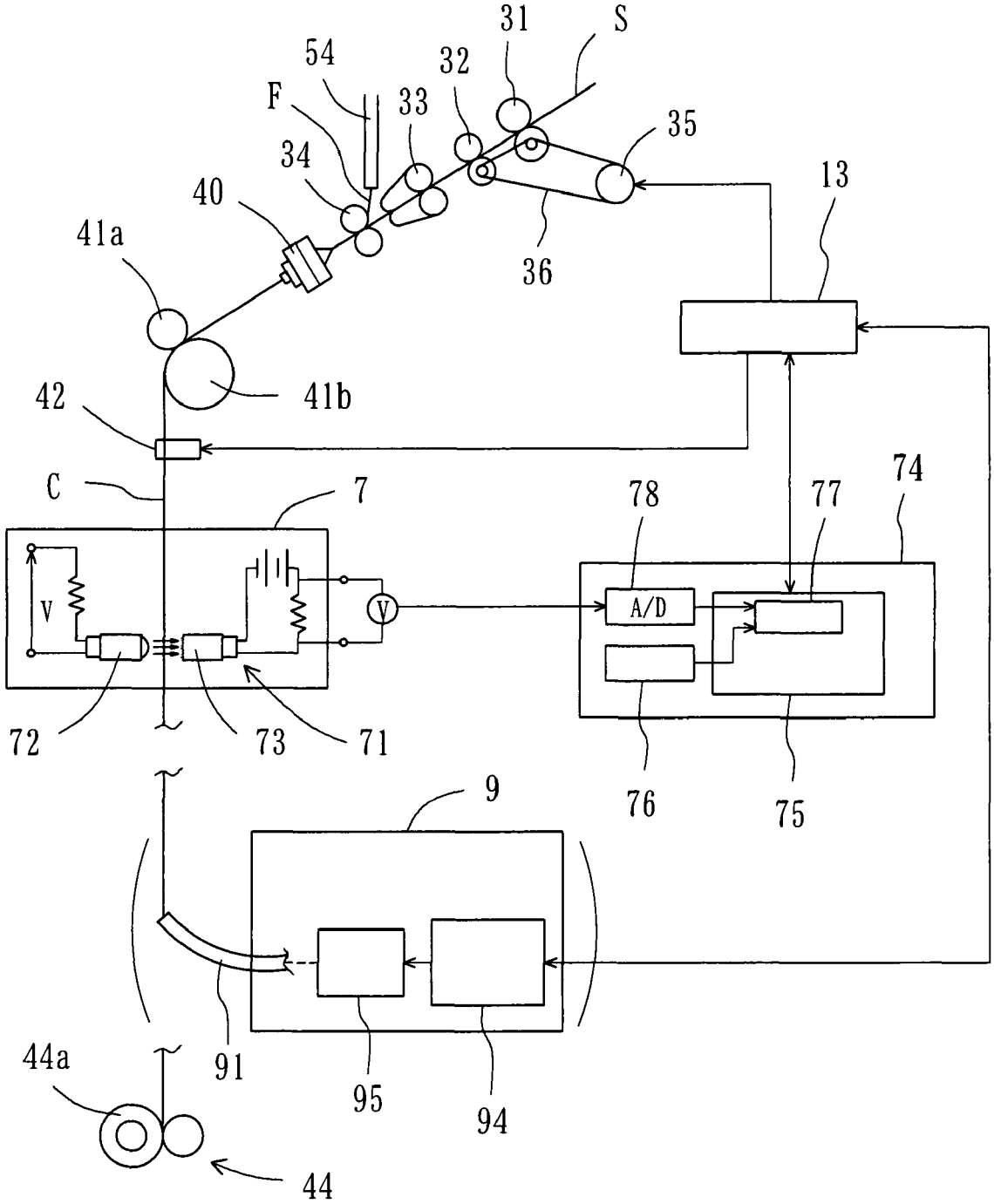
FIG. 3 is a side view of a substantial portion for describing a yarn splicing operation, etc., in the first embodiment.
Figure 4:
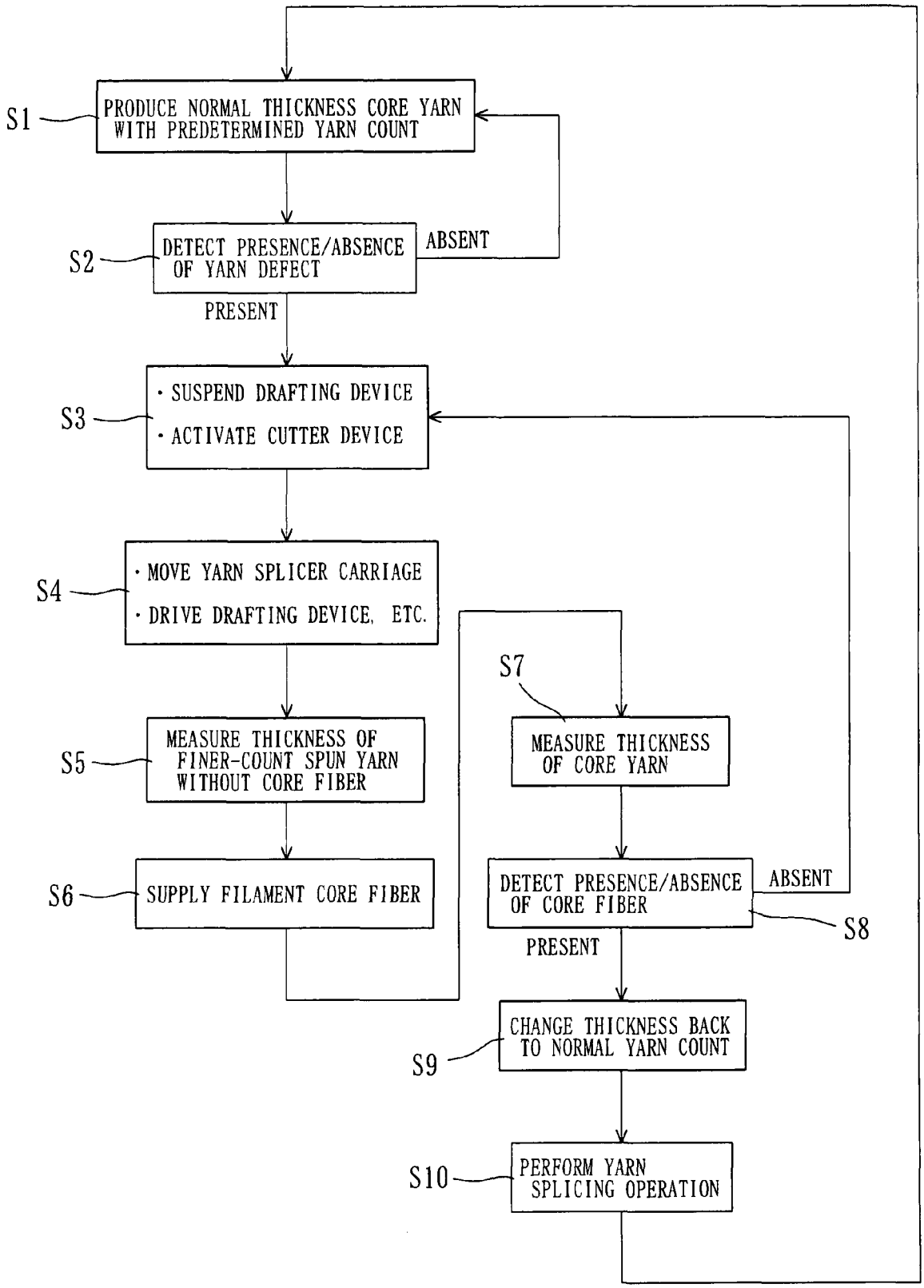
FIG. 4 is a flowchart for describing the yarn splicing operation, etc., in the first embodiment.
Figure 5:
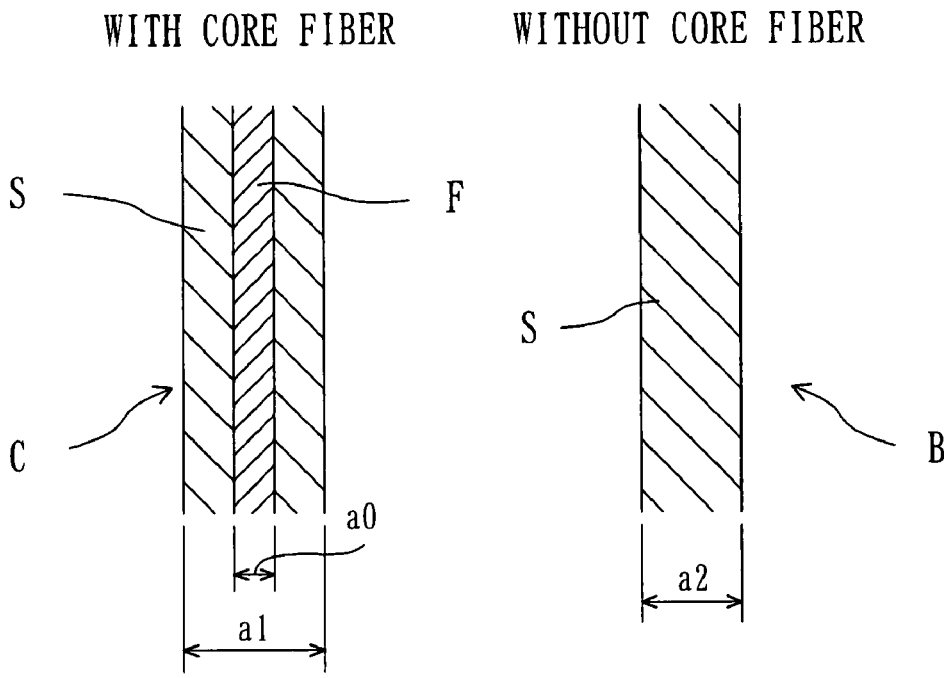
FIG. 5 is related to a core yarn and a spun yarn, which have been reduced in thickness down to a finer count, where (a) is a magnified cross-sectional view, and (b) is a graph illustrating the output voltage of a slub catcher.
Figure 5:
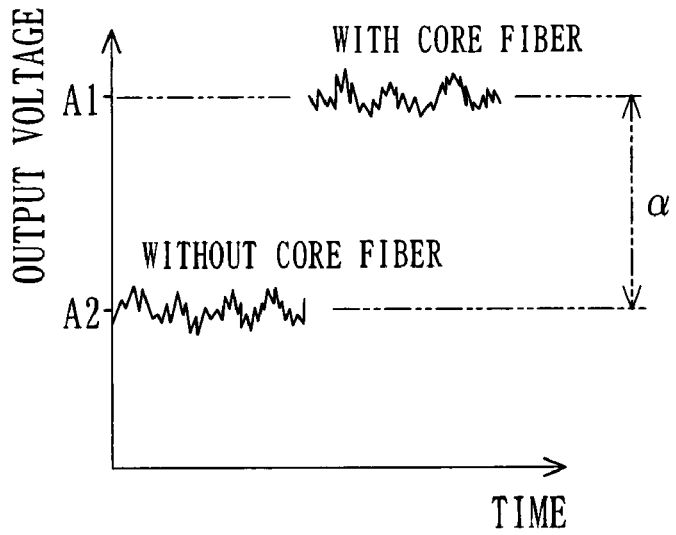
Figure 6:
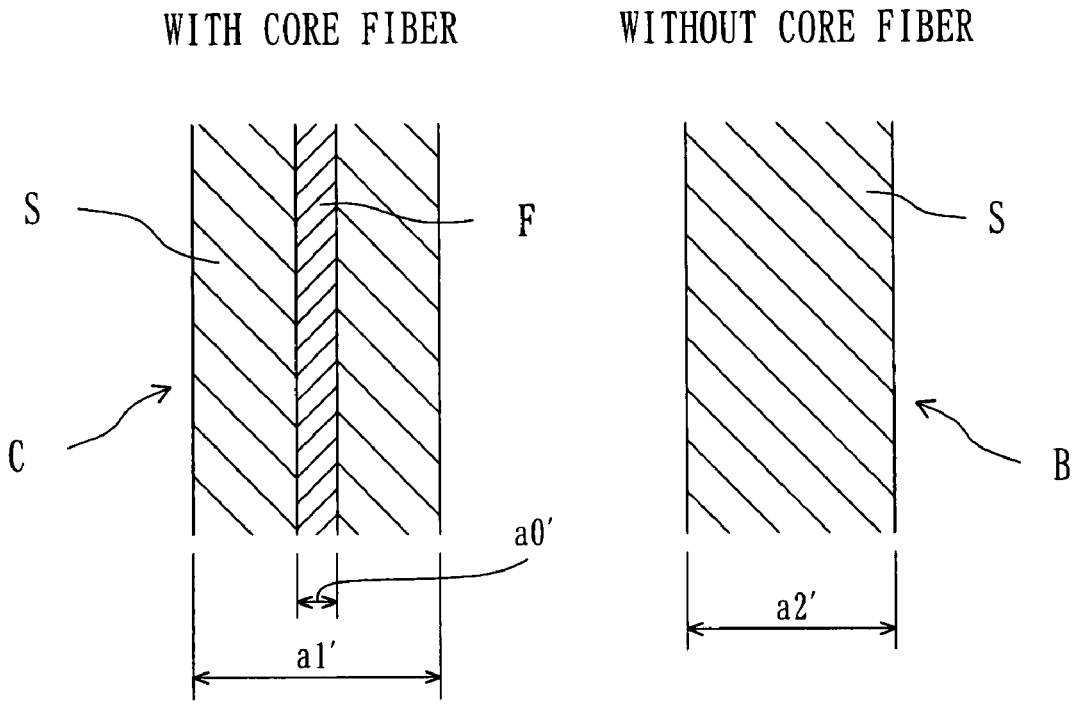
FIG. 6 is related to a core yarn and a spun yarn, which are not reduced in thickness down to a finer count, where (a) is a magnified cross-sectional view, and (b) is a graph illustrating the output voltage of the slub catcher.
Figure 6:
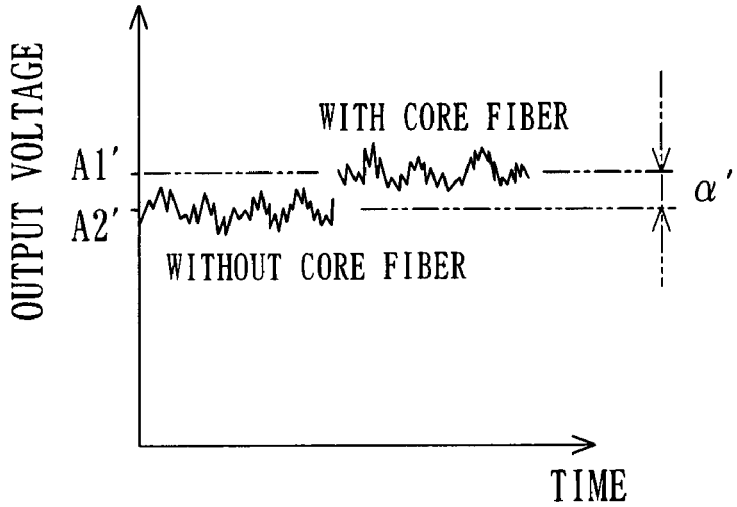

Described next are operations after a yarn defect is detected by the slub catcher 7, in which the yarn defect is eliminated and yarn splicing is performed. FIG. 3 is a side view of a substantial portion for describing the yarn splicing operation, etc. FIG. 4 is a flowchart for describing the yarn splicing operation, etc. FIG. 5 is related to a core yarn and a spun yarn, which have been reduced in thickness down to a finer count, where (a) is a magnified cross-sectional view, and (b) is a graph illustrating the output voltage of the slub catcher. FIG. 6 is related to a core yarn and a spun yarn, which are not reduced in thickness down to a finer count, where (a) is a magnified cross-sectional view, and (b) is a graph illustrating the output voltage of the slub catcher.

The cutter device 42 and the slub catcher 7 are provided on the front side of the machine frame 15, such that a core yarn C spun by the spinning device 40 travels therethrough (see FIG. 2). Moreover, any defect of the traveling core yarn C can be detected by the slub catcher 7 and a slub catcher controller 74 connected to the slub catcher 7.

The slub catcher 7 includes a detecting portion 71 for detecting the yarn defect. The detecting portion 71 is composed of a light emitting portion 72, which is made of luminous elements such as LEDs, and a light reception portion 73, which is made of photoelectric conversion elements. Light emitted by the light emitting portion 72 is blocked by the core yarn C, so that a shadow is formed on the light reception portion 73, which converts the size (area) of the shadow into an electric signal. The light reception portion 73 is configured such that a voltage level increases in proportion to the size of the shadow.

The slub catcher controller 74 includes a control portion 75, a memory portion 76, a comparison portion 77, etc. The memory portion 76 memorizes a predetermined voltage level (a voltage tolerance level) in order to detect the presence/absence of any yarn defect or core fiber. The control portion 75 controls, for example, communications with the spinning unit controller 13. Furthermore, the control portion 75 is provided with the comparison portion 77 by which the voltage tolerance level memorized in the memory portion 76 is compared to the level of a voltage inputted from the light reception portion 73.

With the above configuration, voltage signals from the light reception portion 73 are inputted to the slub catcher controller 74 one after another, making it possible to monitor the thickness of the traveling core yarn C. Specifically, when the thickness (profile thickness) of the traveling core yarn C fluctuates, the size of the shadow formed on the light reception portion 73 also fluctuates, so that the level of the voltage outputted by the light reception portion 73 fluctuates. The voltage level is digitally converted by an A/D converter 78, and thereafter inputted to the comparison portion 77, where the voltage level is compared with the voltage tolerance level memorized in the memory portion 76.

When any yarn defect is present in the core yarn C, the level of the voltage outputted by the light reception portion 73 exceeds the voltage tolerance level memorized in the memory portion 76 (the voltage level falling within the tolerable range for a normal thickness core yarn C), so that the control portion 75 sends a signal to the spinning unit controller 13 (S2). This signal starts the next operation to eliminate the yarn defect from the core yarn C and carry out yarn splicing.

Immediately after receiving the signal, the spinning unit controller 13 activates the cutter device 42 to cut the core yarn C, and suspends the drafting device 3, the core fiber supply device 5 and the spinning device 40 (S3) before sending a signal to a yarn splicer carriage controller 94. As a result, the yarn splicer carriage 9 moves to the front of an appropriate spinning unit 1. Thereafter, the spinning unit controller 13 restarts the drafting device 3, and the spinning device 40 (S4).

At this time, the spinning unit controller 13 controls a drive motor 35, which drives the back rollers 31 and the third rollers 32 via a belt 36 extending therethrough, to decrease the rotational speed of the back rollers 31 and the third rollers 32 below normal speed. As a result, the sliver S is supplied at a lower rate than it is in normal take-up operation. Furthermore, the clamp/cutter 55 is controlled to hold the core fiber F from the core fiber supply device 5, thereby suspending the supply of the core fiber F. With the above operations, a finer-count spun yarn B without a core fiber is temporarily discharged.

Then, the yarn splicer carriage 9 suctions and catches the spun yarn B on the discharge side by means of the suction pipe 91, and guides the spun yarn B such that the spun yarn B passes through the cutting device 42 and the slub catcher 7. At this time, as shown in FIG. 5, an average voltage level A2 for the diameter a2 of the finer-count spun yarn B without a core fiber is first detected by the slub catcher 7, and memorized to the memory portion 76 (S5).

Thereafter, a filament core fiber F is supplied from the core fiber supply device 5 to spin a finer-count core yarn C with the core fiber F (in some cases, the core fiber F may not be contained due to erroneous merging) (S6). Then, an average voltage level A1 for the diameter a1 of the core yarn C is detected by the slub catcher 7, and inputted to the comparison portion 77 (S7).

With the above operations, a voltage differential (a) between the average voltage level A1 (the thickness of the finer-count core yarn C with a core fiber) and the average voltage level A2 (the thickness of the finer-count spun yarn B without a core fiber) is calculated, and inputted to the comparison portion 77.

In addition, the slub catcher controller 74 has a predetermined threshold voltage memorized in the memory portion 76. This threshold is intended to determine whether any core fiber is present in the core yarn C. The comparison portion 77 determines that the core yarn C is normal and contains the core fiber F when the voltage differential ($\alpha$) is equal to or more than the threshold, whereas it is determined that the core yarn C is defective and contains no core fiber F when the voltage differential ($\alpha$) is less than the threshold (S8).

Since the defective core yarn C containing no core fiber F does not vary in diameter before and after the supply of the core fiber F, and the area of its shadow also does not vary, the voltage differential ($\alpha$) is low. Accordingly, in the case of the defective core yarn C, the voltage differential ($\alpha$) falls below the threshold.

As mentioned earlier, the core yarn C is temporarily spun into a finer count yarn, thereby increasing the difference in diameter of the core yarn C between when the core fiber F is present and when the core fiber F is absent, so that the fluctuation in output voltage (the voltage differential (α)) of the light reception portion 73 is increased, making it easier for the slub catcher controller 74 to determine whether the core yarn C contains the core fiber F (see (b) of FIG. 5).

Specifically, in the case of determining whether the core yarn C with a normal coarse count contains the core fiber F without spinning the core yarn C into a finer count yarn, as shown in FIG. 6, a voltage differential (α') between an average voltage level A1' for the diameter a1' with a core fiber and an average voltage level A2' for the diameter a2' without a core fiber is extremely low, and therefore the thickness fluctuation cannot be clearly confirmed, resulting in a high possibility of erroneous determination.

By spinning the finer-count yarn for a predetermined time period during which core fiber detection is performed, thereby making adjustments such that the diameter a0 of the core fiber F is equivalent to 10 to 50% of the diameter a1 of the core yarn C, it becomes possible to increase the voltage differential (α), and thereby to clearly determine the presence/absence of the core fiber.

When it is determined that the core yarn C is normal and contains the core fiber, the spinning unit controller 13 sends a signal to the drive motor 35 to increase the decreased rotational speed of the back rollers 31 and the third rollers 32 back to normal speed, thereby causing the finer-count core yarn C to return to its normal thickness (S9). Thereafter, the yarn splicer carriage 9 continues the yarn splicing operation (S10). As a result, the core yarn C is produced in normal thickness with a predetermined yarn count (S1).

On the other hand, when it is determined that the core yarn C is defective and contains no core fiber, the control portion 75 of the slub catcher controller 74 sends a signal to the spinning unit controller 13. Immediately after receiving the signal, the spinning unit controller 13 cuts the defective core yarn with the cutting device 42, and restarts the operations as described above (S3 to S8). Alternatively, abnormality may be reported to stop driving the core yarn spinning machine, so that the operator can manually eliminate the abnormality.

Second Embodiment

Figure 7:
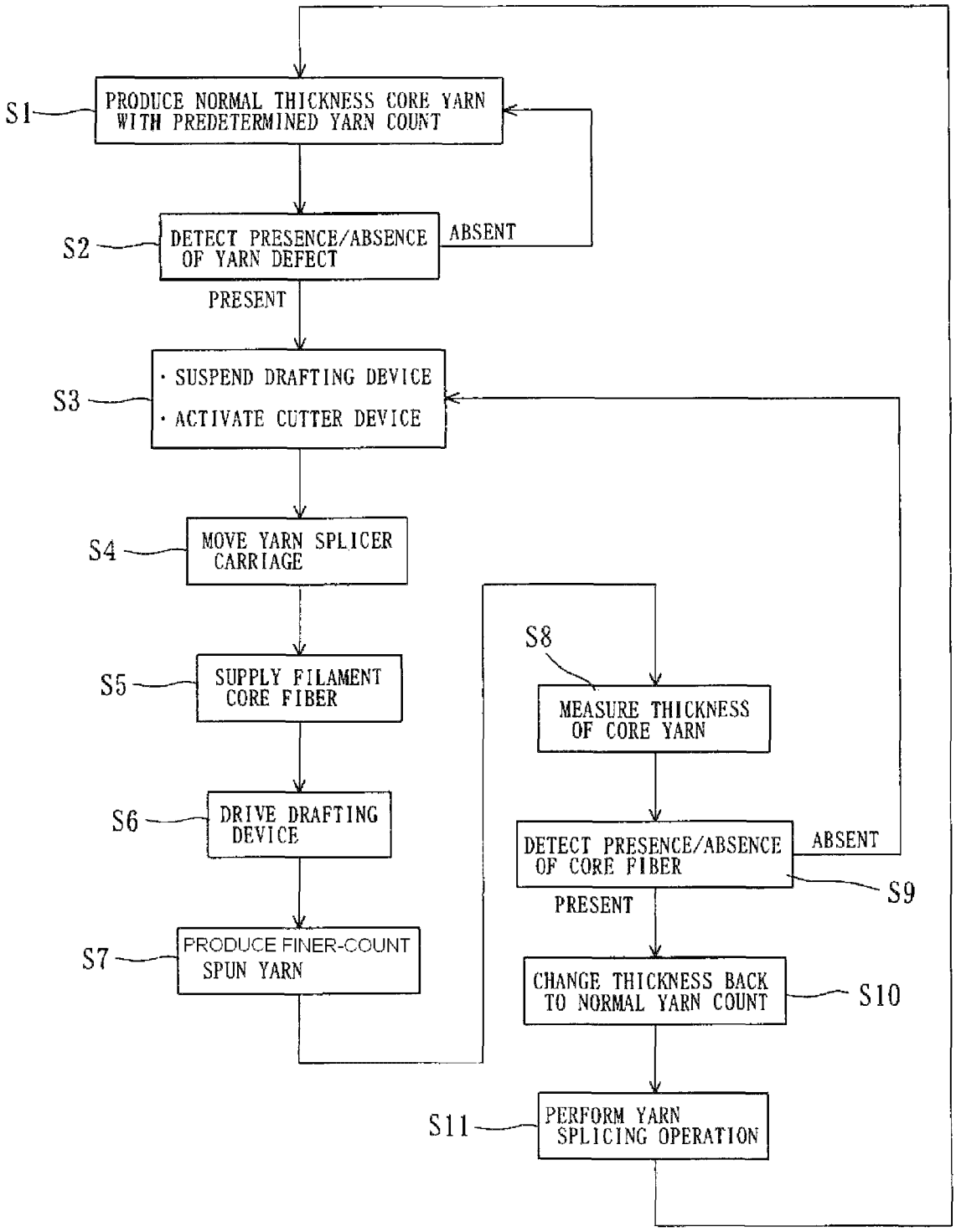
FIG. 7 is a flowchart for describing a yarn splicing operation, etc., in a second embodiment.

Described next is a second embodiment. FIG. 7 is a flowchart for describing the yarn splicing operation, etc. The second embodiment is similar to the first embodiment in terms of configuration, and therefore only their differences will be described in detail.

In the second embodiment, the average voltage level A2 for the diameter a2 of the finer-count spun yarn B without a core fiber (see FIG. 5) is premeasured and memorized to the memory portion 76. Accordingly, after the production of the core yarn in normal thickness with a predetermined yarn count (S1), the detection of the presence/absence of any yarn defect (S2), the suspension of the drafting device, the activation of the cutting device (S3), and the movement of the yarn splicer carriage (S4) (all of which are the same as in the first embodiment), the filament core fiber F is supplied (S5), the drafting device is driven (S6) and the finer-count core yarn C is produced (S7).

The average voltage level A1 for the diameter a1 of the finer-count core yarn C with a core fiber (see FIG. 5) is inputted to the comparison portion 77 (S8). The presence/absence of the core fiber is detected based on the voltage differential (α) between the average voltage level A1 (the thickness of the finer-count core yarn C with a core fiber) and the prememorized average voltage level A2 (the thickness of the finer-count spun yarn B without a core fiber) (S9).

When it is determined that the core yarn C is normal and contains the core fiber F, the decreased rotational speed is increased back to normal speed, thereby causing the core yarn C to return to its normal yarn count (S10). Thereafter, the yarn splicing operation is continued (S11) to produce the core yarn C with a predetermined yarn count (S1). When it is determined that the core yarn C is defective and contains no core fiber F, the defective core yarn is cut by the cutting device 42, and the above-described operations are restarted (S3 to S9).

Third Embodiment

Figure 8:
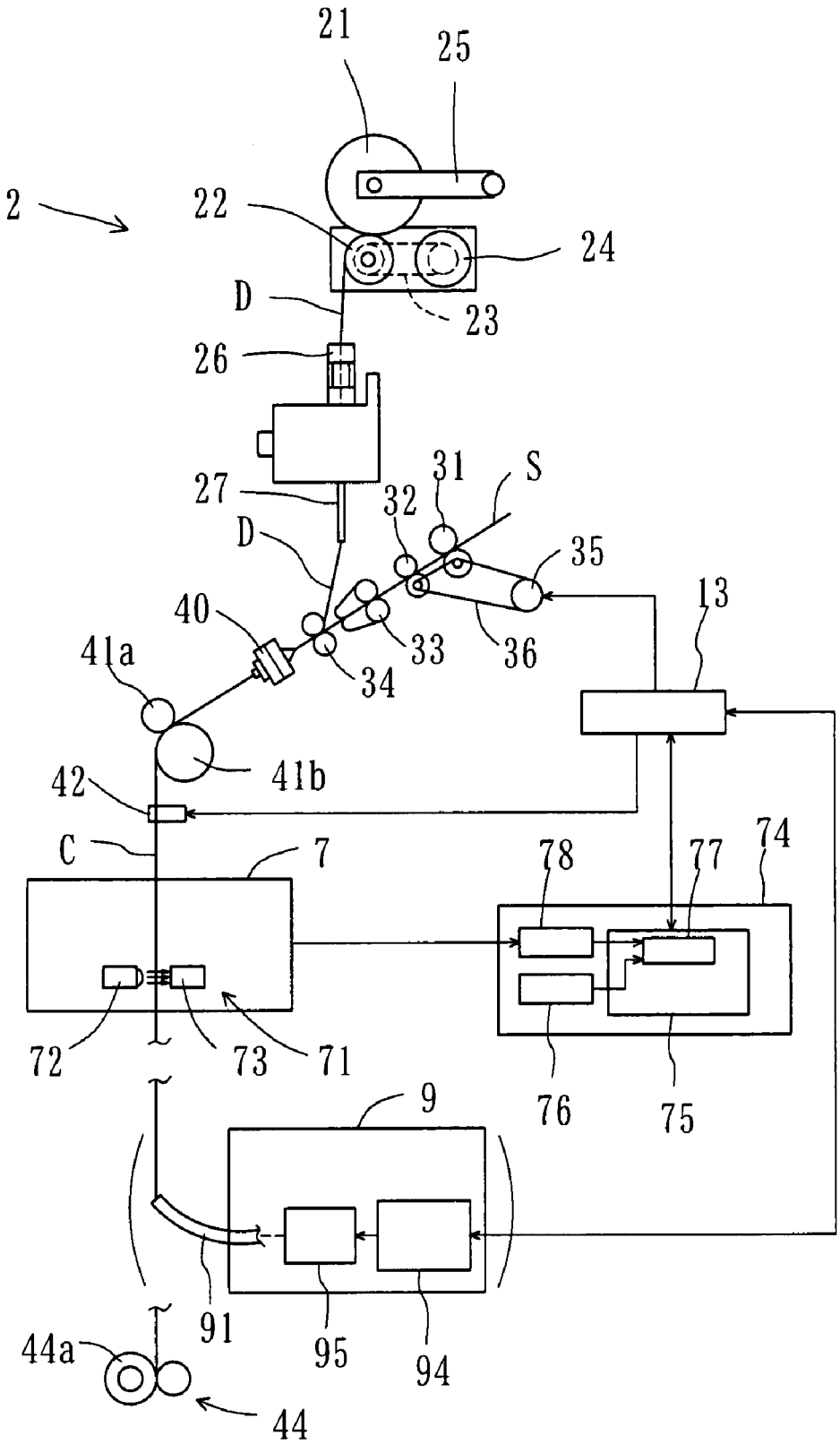
FIG. 8 is a side view of a substantial portion, which illustrates a core yarn spinning machine in a third embodiment.

Next, a third embodiment will be described in detail. Descriptions of the same portions as in the first and second embodiments will be omitted. FIG. 8 is a side view of a substantial portion of a core yarn spinning machine. The core yarn spinning machine according to the third embodiment includes an elastic core fiber supply device 2 in place of the core fiber supply device 5 in the first and second embodiments.

The elastic core fiber supply device 2 includes an elastic core fiber package 21, and also a rotating roller 22, which rotates in contact with the circumferential surface of the elastic core fiber package 21. The rotating roller 22 is rotated via a belt 23 driven by a drive motor 24. The elastic core fiber package 21 is rotatably supported by cradle arms 25.

After being unwound from the elastic core fiber package 21 through the rotation of the rotating roller 22, an elastic core fiber D is caused to pass through the supply guiding tube 27 by a jet of high pressure exhaust air from the air sucker device 26. Thereafter, the elastic core fiber D is supplied from the supply guiding tube 27 to a position slightly upstream of the front rollers 34, so that the elastic core fiber D is merged with a fiber bundle, and introduced to the spinning device 40.

The rotational speed of the delivery roller 41*a* in the yarn feeding device 41 is set higher than that of the rotating roller 22 in the elastic core fiber supply device 2, and therefore, spinning is performed with the elastic core fiber D being stretched (e.g., three times in length).

Figure 9:
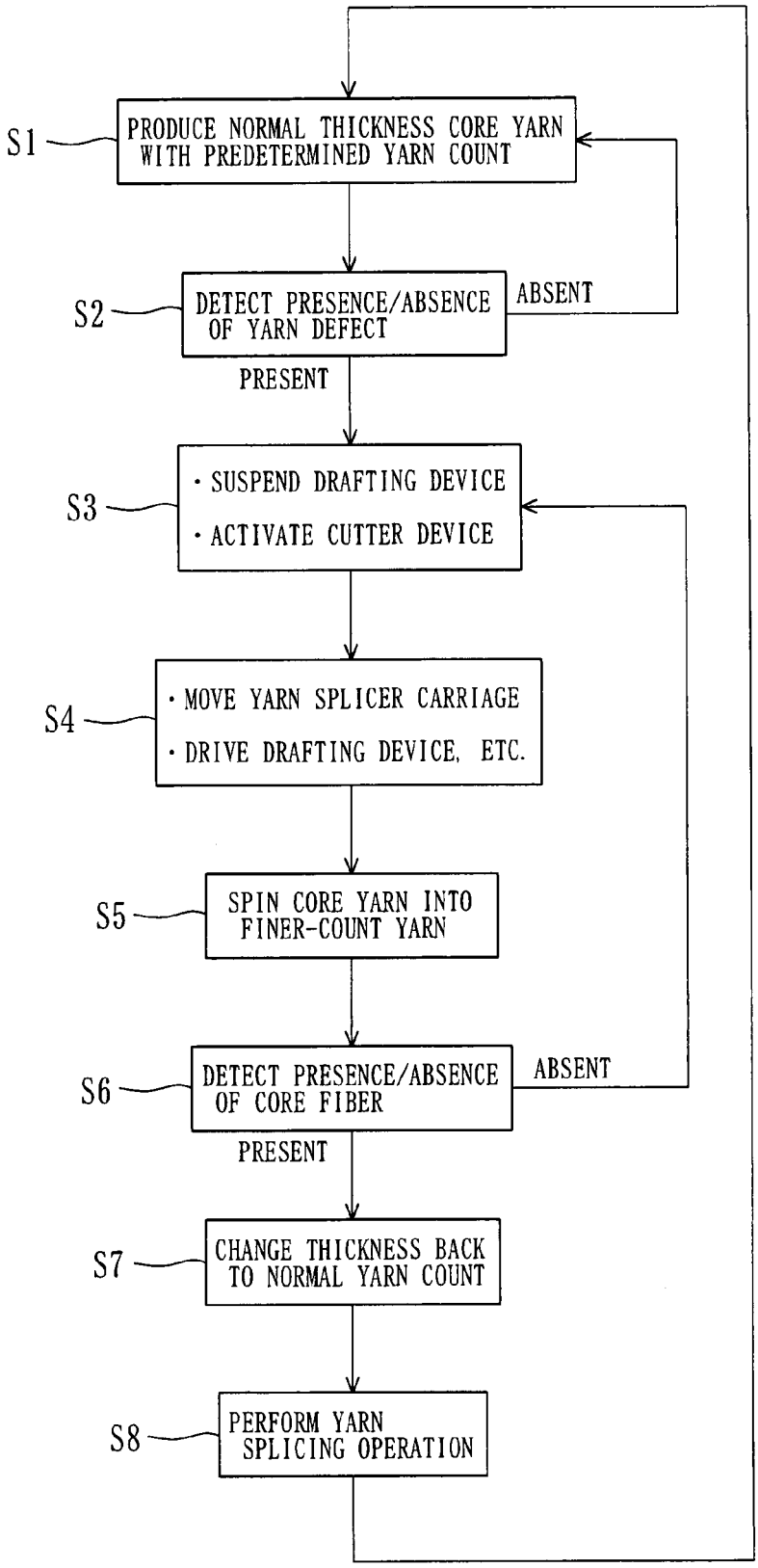
FIG. 9 is a flowchart for describing a yarn splicing operation, etc., in the third embodiment.
Figure 10:
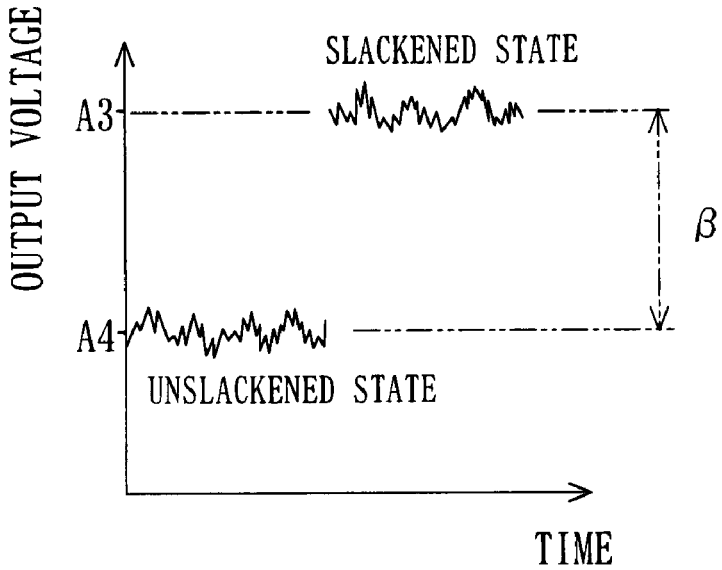
FIG. 10 is a graph illustrating the output voltage of the slub catcher with respect to both the cases of slackened and unslackened core yarns.
Figure 10:
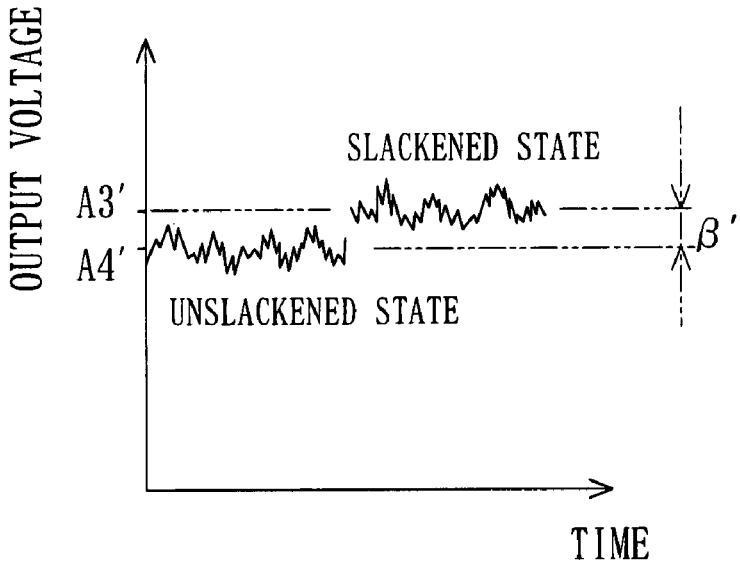

Described next are operations after a yarn defect is detected by the slub catcher, in which the yarn defect is eliminated and yarn splicing is performed. FIG. 9 is a flowchart for describing the yarn splicing operation, etc. FIG. 10 is a graph illustrating the output voltage of the slub catcher with respect to both the cases of slackened and unslackened core yarns.

When any yarn defect is present in the core yarn C, the level of a voltage outputted by the light reception portion 73 exceeds a tolerable voltage range, so that the control portion 75 sends a signal to the spinning unit controller 13 (S2). This signal starts the next operation to eliminate the yarn defect from the core yarn C.

Immediately after receiving the signal, the spinning unit controller 13 activates the cutter device 42 to cut the core yarn C, and suspends the drafting device 3, the elastic core fiber supply device 2 and the spinning device 40 (S3) before sending a signal to a yarn splicer carriage controller 94. As a result, the yarn splicer carriage 9 moves to the front of an appropriate spinning unit 1. Thereafter, the spinning unit controller 13 restarts the drafting device 3, the elastic core fiber supply device 2, and the spinning device 40 (S4).

At this time, the spinning unit controller 13 controls the drive motor 35, which drives the back rollers 31 and the third rollers 32 via the belt 36 extending therethrough, to decrease the rotational speed of the back rollers 31 and the third rollers 32. As a result, the sliver S is supplied at a lower rate than it is at the time of take-up operation, such that the core yarn C with a finer-yarn count is spun for a predetermined time period.

Thereafter, the yarn splicer carriage 9 first suctions and catches the core yarn C on the discharge side by the suction pipe 91, and guides the core yarn C so that the core yarn C passes through the cutting device 42 and the slub catcher 7. At this time, the suction power of the suction flow generation source 95 is set lower than the yarn feeding power of the yarn feeding device 41 by the yarn splicer carriage controller 94. Thus, the tension of the core yarn C between the yarn feeding device 41 and the suction pipe 91 is lower than the tension of the core yarn C at a portion upstream of the yarn feeding device 41.

The core yarn C is spun with the fiber bundle made of sliver S wrapping therearound and the elastic core fiber D being drawn as its core fiber. Accordingly, by setting the suction power of the suction pipe 91 at low level, the core yarn C between the yarn feeding device 41 and the suction pipe 91 is slackened, so that it is crimped after lengthwise contraction and radial expansion. Thus, the degree of slackness (the radial expansion) of the core yarn C can be adjusted in accordance with the setting of the suction power of the suction pipe 91.

Furthermore, the radial expansion tendency is increased by decreasing the supply rate of the fiber bundle to reduce the thickness of the core yarn C to a finer-yarn count as mentioned earlier.

Thereafter, as shown in (a) of FIG. 10, when the finer-count core yarn C is being spun (S5), an average voltage level A4 for the thickness of the unslackened core yarn C is first memorized to the memory portion 76. Thereafter, the finer-count core yarn C is slackened, and an average voltage level A3 for the slackened state is inputted to the comparison portion 77. As a result, a voltage differential (β) between the average voltage level A3 (the thickness of the slackened finer-count core yarn) and the average voltage level A4 (the thickness of the unslackened finer-count core yarn) is calculated, and the voltage differential (β) is inputted to the comparison portion 77.

The slub catcher controller 74 has a threshold voltage memorized in the memory portion 76. The comparison portion 77 determines that the core yarn C is normal and contains the elastic core fiber D when the voltage differential (β) is equal to or more than the threshold, whereas it is determined that the core yarn C is defective and contains no elastic core fiber D when the voltage differential (β) is less than the threshold (S6).

In addition, the defective core yarn C without the elastic core fiber D does not exhibit the aforementioned radial expansion tendency, so that the area of the shadow is left almost unchanged, and the voltage differential (β) is low. Accordingly, in the case of the defective core yarn C, the voltage differential (β) falls below the threshold.

As mentioned earlier, the core yarn C is temporarily spun into a finer count yarn, thereby increasing the radial expansion tendency of the core yarn C, so that the fluctuation in output voltage (the voltage differential (β)) of the light reception portion 73 is increased, making it easier for the slub catcher controller 74 to determine whether the core yarn C contains the elastic core fiber (see (a) of FIG. 10).

Specifically, In the case of determining whether the core yarn C with a predetermined yarn count contains the elastic core fiber D without spinning the core yarn C into a finer count yarn, as shown in (b) of FIG. 10, a voltage differential (β') between an average voltage level A3' for the slackened state and an average voltage level A4' for the unslackened state is extremely low, and therefore the thickness fluctuation cannot be clearly confirmed, resulting in a high possibility of erroneous determination.

When it is determined that the core yarn C is normal and contains the elastic core fiber, the spinning unit controller 13 sends a signal to the drive motor 35 to increase the decreased rotational speed of the back rollers 31 and the third rollers 32 back to normal speed, thereby causing the finer-count core yarn C back to its normal thickness (S7). Thereafter, the yarn splicer carriage 9 continues the yarn splicing operation (S8). As a result, the core yarn C is produced in normal thickness with a predetermined yarn count (S1).

On the other hand, when it is determined that the core yarn C is defective and contains no elastic core fiber, the control portion 75 of the slub catcher controller 74 sends a signal to the spinning unit controller 13. Immediately after receiving the signal, the spinning unit controller 13 cuts the defective core yarn with the cutting device 42, and restarts the operations as described above (S3 to S6). Alternatively, abnormality may be reported to stop the drive, so that the operator can manually remove the abnormality.

Fourth Embodiment

Figure 11:
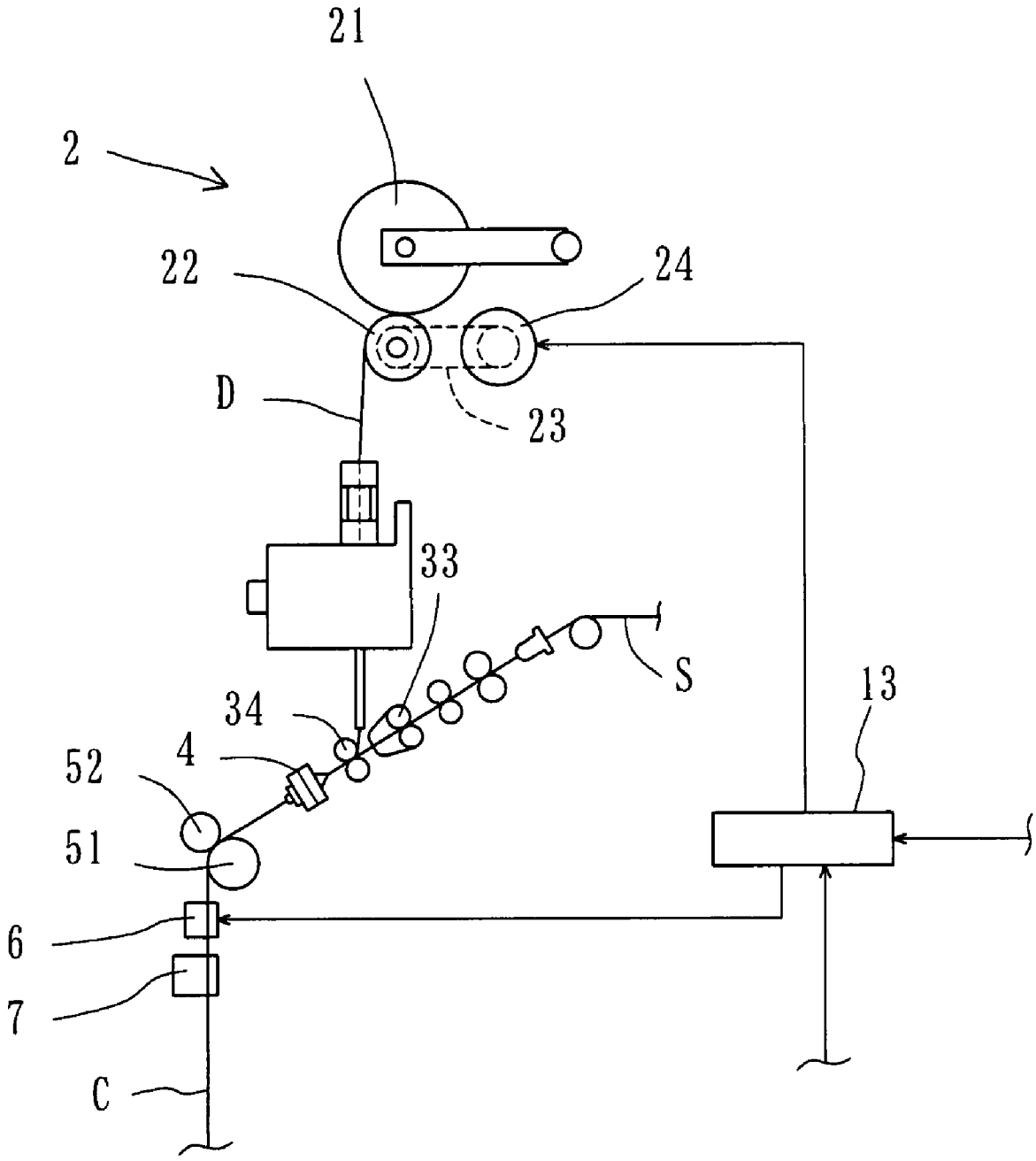
FIG. 11 is a side view of a substantial portion for describing a yarn splicing operation, etc., in a fourth embodiment.
Figure 12:
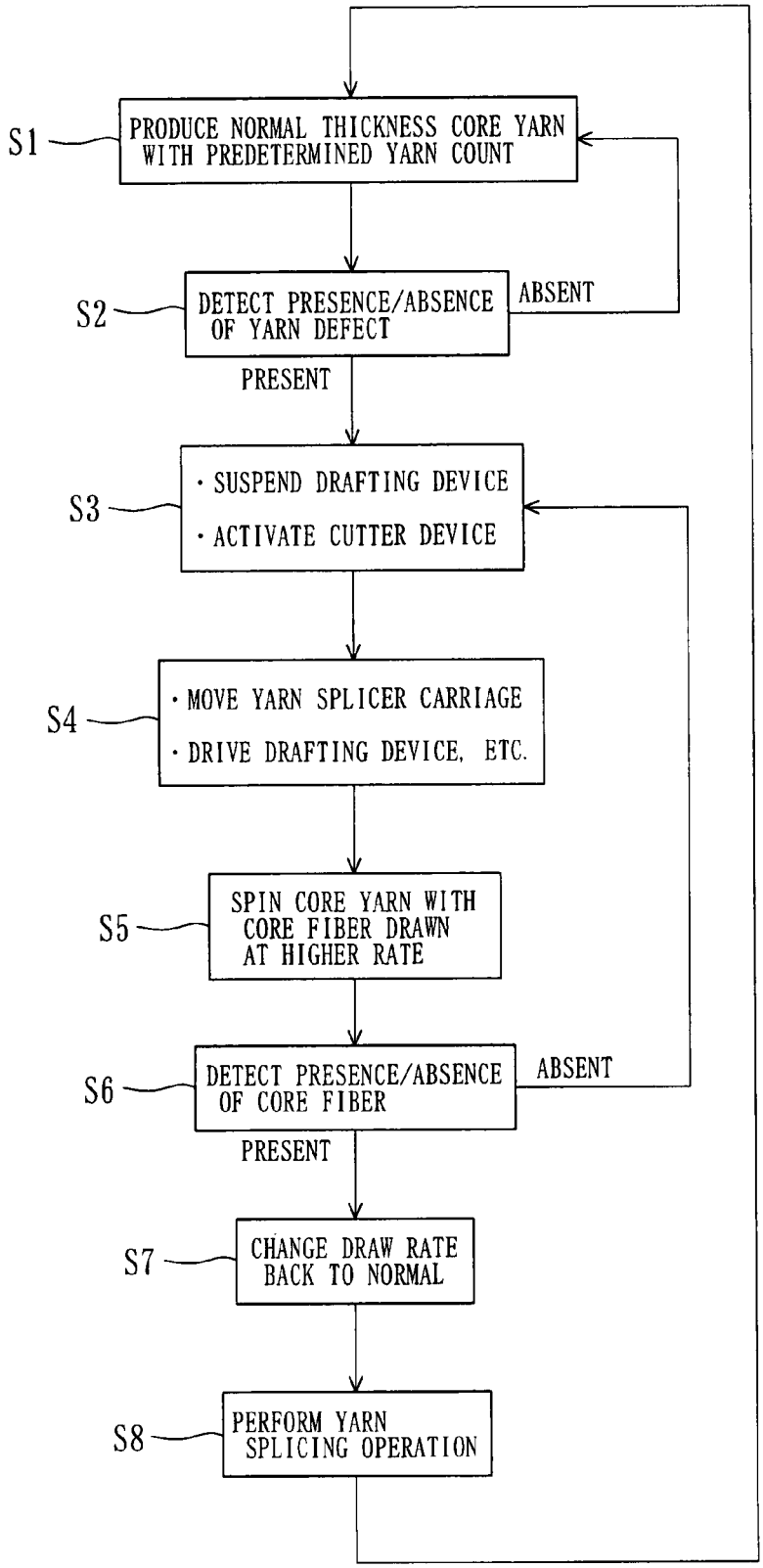
FIG. 12 is a flowchart for describing the yarn splicing operation, etc., in the fourth embodiment.

Described next is a fourth embodiment in which the core yarn is spun with a core fiber at a higher drawn ratio than in normal operation, thereby changing the core fiber content. FIG. 11 is a side view of a substantial portion for describing the yarn splicing operation, etc. FIG. 12 is a flowchart for describing the yarn splicing operation, etc. The fourth embodiment is similar to the third embodiment, and therefore only their differences will be described in detail.

The spinning unit controller 13 is connected to the elastic package drive motor 24 of the elastic core fiber supply device 2 so as to control the rotational speed of the drive motor 24. After the production of the core yarn with a predetermined yarn count (S1), the detection of any yarn defect (S2), the suspension of the drafting device, and the activation of the cutting device (S3), the movement of the yarn splicer carriage, and the driving of the drafting device and so on (S4) (all of which are the same as in the third embodiment), the rotational speed of the drive motor 24 is decreased below normal speed. As a result, the elastic core fiber D is fed while being stretched more than in normal operation, and therefore the core yarn is spun with the elastic core fiber D drawn at a higher rate than in normal operation (S5).

As shown in (a) of FIG. 10, it is determined that the core yarn C with the elastic core fiber D drawn at the higher rate is normal and contains the elastic core fiber D when the voltage differential (β) between the average voltage level A4 for the unslackened state and the average voltage level A3 for the slackened state is equal to or more than a predetermined threshold, whereas it is determined that the core yarn C is defective and contains no elastic core fiber D when the voltage differential (β) is less than the threshold (S6).

In the fourth embodiment, the drawn rate of the elastic core fiber D is temporarily increased, thereby increasing the restoring force of the core yarn C, so that the radial expansion tendency of the slackened core yarn C is increased, and the fluctuation in the output voltage (the voltage differential (β)) of the light reception portion 73 is increased, making it easier for the slub catcher controller 74 to determine whether the core yarn C contains the elastic core fiber D.

Specifically, in the case of determining whether the core yarn C contains the elastic core fiber D without increasing the drawn rate of the elastic core fiber D, so that the core yarn C remains with normal drawn rate, as shown in (b) of FIG. 10, the voltage differential (β') between the average voltage A3' for the slackened state and the average voltage A4' for the unslackened state is extremely low, and therefore the thickness fluctuation cannot be clearly confirmed, resulting in a high possibility of erroneous determination.

When it is determined that the core yarn C is normal and contains the elastic core fiber D, the spinning unit controller 13 sends a signal to the drive motor 24 to increase the decreased rotational speed back to normal speed, thereby spinning the core yarn C with the elastic core fiber D drawn at normal rate (S7). Thereafter, the yarn splicing operation is continued (S8), and the core yarn C is produced with a predetermined yarn count (S1).

On the other hand, when it is determined that the core yarn C is defective and contains no elastic core fiber D, the control portion 75 of the slub catcher controller 74 sends a signal to the spinning unit controller 13. Immediately after receiving the signal, the spinning unit controller 13 cuts the defective core yarn with the cutting device 42, and restarts the operations as described above (S3 to S6).

In the present embodiment, the slub catcher is used as a core fiber presence/absence determination device, but the core fiber presence/absence determination device may be provided independently of the slub catcher. The above-described embodiments are directed to the core yarn spinning machine, but can be applied to, for example, simple core yarn take-up devices with the function of taking up the core yarn. The slub catcher is not limited to that of photoelectric type, and may be of capacitance type, for example.

The invention claimed is:

1. A core fiber detecting method in core yarn spinning for use in a method for producing a core yarn by wrapping a fiber bundle around a core fiber, wherein the core yarn is spun with a core fiber content being purposefully changed from that of normal spinning for a predetermined time period after spinning is started after a suspension, in order to detect whether the core yarn contains the core fiber.

2. The core fiber detecting method in core yarn spinning according to claim 1, wherein the core yarn is spun into a finer-count yarn than in a normal operation, thereby changing the core fiber content.

3. The core fiber detecting method in core yarn spinning according to claim 2, wherein a rotational speed of a predetermined drafting roller in a drafting device is adjusted to change the count of the core yarn.

4. The core fiber detecting method in core yarn spinning according to claim 1, wherein the core yarn is spun with a core fiber made of a drawn elastic yarn, and whether the core fiber is present is detected based on a thickness fluctuation of the core yarn that is caused by slackening the core yarn.

5. The core fiber detecting method in core yarn spinning according to claim 4, wherein the core yarn is spun with a core fiber drawn at a higher rate than in a normal operation, thereby changing the core fiber content.

6. A core fiber detecting device in core yarn spinning for detecting whether a core fiber is present, the device being included in an apparatus for producing a core yarn by wrapping a fiber bundle around the core fiber, wherein the device comprises content changing means for spinning the core yarn with a changed core fiber content, and the core yarn is spun with the core fiber content being purposefully changed from that of normal spinning for a predetermined time period after spinning is started alter a suspension, in order to detect whether the core yarn contains the core fiber.

7. The core fiber detecting device in core yarn spinning according to claim 6, wherein the content changing means is a device that spins the core yarn into a finer-count yarn than in a normal operation.

8. The core fiber detecting device in core yarn spinning according to claim 6, wherein the content changing means includes a device that changes a rotational speed of a predetermined drafting roller in a drafting device.

9. The core fiber detecting device in a core yarn spinning according to claim 6, wherein the core yarn production apparatus spins the core yarn with a core fiber made of a drawn elastic yarn, and the core fiber detecting device detects whether the core fiber is present based on a thickness fluctuation of the core yarn that is caused by slackening the core yarn.

10. The core fiber detecting device in core yarn spinning according to claim 9, wherein the content changing means is a device that changes a drawn rate of the elastic core fiber.

11. The core fiber detecting method in core yarn spinning according to claim 2, wherein the core yarn is spun with a core fiber made of a drawn elastic yarn, and whether the core fiber is present is detected based on a thickness fluctuation of the core yarn that is caused by slackening the core yarn.

12. The core fiber detecting method in core yarn spinning according to claim 3, wherein the core yarn is spun with a core fiber made of a drawn elastic yarn, and whether the core fiber is present is detected based on a thickness fluctuation of the core yarn that is caused by slackening the core yarn.

13. The core fiber detecting method in core yarn spinning according to claim 7, wherein the core yarn production apparatus spins the core yarn with a core fiber made of a drawn elastic yarn, and the core fiber detecting device detects whether the core fiber is present based on a thickness fluctuation of the core yarn that is caused by slackening the core yarn.

14. The core fiber detecting method in core yarn spinning according to claim 8, wherein the core yarn production apparatus spins the core yarn with a core fiber made of a drawn elastic yarn, and the core fiber detecting device detects whether the core fiber is present based on a thickness fluctuation of the core yarn that is caused by slackening the core yarn.

15. A method of core yarn spinning by wrapping a fiber bundle around a core fiber comprising:

setting a content of the core fiber to a normal content;

spinning the core yarn with the content of the core fiber set at the normal content;

for a predetermined time after the spinning the core yarn after a suspension, purposefully changing the content of the core fiber to a second content;

spinning the core yarn with the content of the core fiber set at the second content; and detecting the presence of the core fiber after the spinning the yarn with the parameter set at the second content.

16. A core fiber detecting device for an apparatus producing a core yarn by wrapping a fiber bundle around a core fiber comprising:

means for changing, for a predetermined time after spinning is started after a suspension, a content of the core fiber from a normal content to a second content;

means for detecting the core fiber when the core yarn is produced at the second content.

17. The core fiber detecting method in core yarn spinning according to claim 15, wherein the core yarn is spun into a finer-count yarn than in a normal content, thereby changing the core fiber content.

18. The core fiber detecting method in core yarn spinning according to claim 17, wherein a rotational speed of a predetermined drafting roller in a drafting device is adjusted to change the count of the core yarn.

19. The core fiber detecting method in core yarn spinning according to claim 15, wherein the core yarn is spun with a core fiber made of a drawn elastic yarn, and whether the core fiber is present is detected based on a thickness fluctuation of the core yarn that is caused by slackening the core yarn.

20. The core fiber detecting method in core yarn spinning according to claim 19, wherein the core yarn is spun with a core fiber drawn at a higher rate than in a normal operation, thereby changing the core fiber content.

21. The core fiber detecting method in core yarn spinning according to claim 17, wherein the core yarn is spun with a core fiber made of a drawn elastic yarn, and whether the core fiber is present is detected based on a thickness fluctuation of the core yarn that is caused by slackening the core yarn.

22. The core fiber detecting method in core yarn spinning according to claim 18, wherein the core yarn is spun with a core fiber made of a drawn elastic yarn, and whether the core fiber is present is detected based on a thickness fluctuation of the core yarn that is caused by slackening the core yarn.

23. The core fiber detecting device in core yarn spinning according to claim 16, wherein the content changing means is a device that spins the core yarn into a finer-count yarn than when the core yarn is spun with the content of the core fiber set at the normal content.

24. The core fiber detecting device in core yarn spinning according to claim 16, wherein the content changing means includes a device that changes a rotational speed of a predetermined drafting roller in a drafting device.

25. The core fiber detecting device in a core yarn spinning according to claim 16, wherein the core yarn production apparatus spins the core yam with a core fiber made of a drawn elastic yarn, and the core fiber detecting means determines whether the core fiber is present based on a thickness fluctuation of the core yarn that is caused by slackening the core yarn.

26. The core fiber detecting device in core yarn spinning according to claim 25, wherein the content changing means is a device that changes a drawn rate of the elastic core fiber.

27. The core fiber detecting device in a core yarn spinning according to claim 23, wherein the core yarn production apparatus spins the core yarn with a core fiber made of a drawn elastic yarn, and the core fiber detecting means determines whether the core fiber is present based on a thickness fluctuation of the core yarn that is caused by slackening the core yarn.

28. The core fiber detecting device in a core yarn spinning according to claim 24, wherein the core yarn production apparatus spins the core yarn with a core fiber made of a drawn elastic yarn, and the core fiber detecting means determines whether the core fiber is present based on a thickness fluctuation of the core yarn that is caused by slackening the core yarn.

* * * * *